US007487647B2

(12) United States Patent
Robin et al.

(10) Patent No.: US 7,487,647 B2
(45) Date of Patent: Feb. 10, 2009

(54) EXPANSION VALVE AND METHOD FOR CONTROLLING IT

(75) Inventors: Jean-Jacques Robin, Berglen (DE); Ralf Winterstein, Dettingen/Erms (DE); Klaus Kummerow, Fellbach (DE)

(73) Assignee: Otto Egelhof GmbH & Co. KG, Regelungstechnik, Fellbach (DE)

( * ) Notice: Subject to any disclaimer, the term of this patent is extended or adjusted under 35 U.S.C. 154(b) by 372 days.

(21) Appl. No.: 11/072,993

(22) Filed: Mar. 3, 2005

(65) Prior Publication Data

US 2005/0198979 A1 Sep. 15, 2005

(30) Foreign Application Priority Data

Mar. 3, 2004 (DE) ..... 10 2004 010 997

(51) Int. Cl.
*F25B 41/04* (2006.01)
*G05D 23/02* (2006.01)
*F16K 17/26* (2006.01)

(52) U.S. Cl. ..... 62/222; 236/93 R; 137/493.8

(58) Field of Classification Search ..... 62/222, 62/511; 251/337
See application file for complete search history.

(56) References Cited

U.S. PATENT DOCUMENTS

| | | | | |
|---|---|---|---|---|
| 2,393,589 | A * | 1/1946 | Compton et al. | 137/493.4 |
| 2,654,976 | A * | 10/1953 | Jorgensen | 137/494 |
| 3,952,535 | A * | 4/1976 | Putman | 62/222 |
| 5,025,640 | A * | 6/1991 | Drucker | 62/324.6 |
| 6,286,544 | B1 * | 9/2001 | Miyazoe et al. | 137/505.41 |
| 6,311,950 | B1 * | 11/2001 | Kappel et al. | 251/129.08 |
| 6,430,950 | B1 * | 8/2002 | Dienhart et al. | 62/222 |
| 6,543,239 | B2 * | 4/2003 | Mittelstrass et al. | 62/199 |
| 2005/0126218 | A1 * | 6/2005 | Sohn | 62/527 |
| 2006/0086116 | A1 * | 4/2006 | Robin | 62/222 |

* cited by examiner

*Primary Examiner*—Chen-Wen Jiang
(74) *Attorney, Agent, or Firm*—Kriegsman & Kriegsman

(57) ABSTRACT

The invention relates to an expansion valve and to a method for controlling an expansion valve, in which the opening and closing movement of the valve-closure member is set as a function of the pressure difference which is present in a feed opening on the high pressure side and in a discharge opening.

20 Claims, 5 Drawing Sheets

EXPANSION VALVE AND METHOD FOR CONTROLLING IT

BACKGROUND OF THE INVENTION

1. Field of the Invention

The invention relates to an expansion valve and to a method for controlling it, in particular in the form of vehicle air-conditioning systems which are operated with $CO_2$ as refrigerant and have a valve housing with a feed opening and a discharge opening, and with a valve member which can be displaced out of a valve seat of a through-flow opening arranged between the feed opening and discharge opening to allow the refrigerant to flow through.

2. Description of Related Art

Carbon dioxide ($CO_2$) is the preferred refrigerant for refrigerant cycles of air-conditioning systems of motor vehicles of the future, since this substance is very safe in the event of accidents, on account of being non-combustible, and furthermore it is not considered an environmental pollutant. $CO_2$ refrigeration cycles, unlike R134a refrigeration cycles, are also operated in the supercritical range.

An expansion valve which is used in refrigerant cycles of air-conditioning systems using $CO_2$ is known from DE 100 12 714 A1. This expansion valve has a throttling opening with a fixed cross section for transferring the refrigeration medium from the high-pressure side to the low-pressure side for the purpose of pressure expansion. This cross section is always open for through-flow. If an excess pressure is formed on the high-pressure side in the refrigerant cycle, a bypass valve connected in parallel with the throttling opening is opened, so that the excess pressure which exceeds the optimum high pressure is reduced. The bypass valve only opens when a predetermined threshold value is exceeded on the high-pressure side.

This arrangement represents a functionally reliable configuration of an expansion valve, but it is necessary for both the setting of the threshold value and of the orifice diameter to be matched to the particular air-conditioning system, in order to achieve a maximum performance coefficient over the entire range of applications of the air-conditioning system.

DE 102 19 667 A1 has disclosed an expansion valve with an electronic control which has an electrically actuable device for displacement of a valve member, with a further throttling location, the passage cross section of which can be adjusted in a manner coupled to the passage cross section of the first throttling location, being provided arranged in series with the first throttling location. This series connection of at least two throttling locations, of which at least one can be actuated by a solenoid valve, means that the pressure difference at each individual throttling location is lower than if there is just one throttling location. This increases the accuracy of control. In particular, it is possible to thereby deal with the discrepancies in the pressure difference which occur between summer and winter.

However, this solution has the drawback of requiring a complex structure. Actuation of the solenoid valve requires the use of a pressure and temperature sensor or a control box with software in the control circuit, making this expansion valve expensive to produce and assemble.

BRIEF SUMMARY OF THE INVENTION

Therefore, the invention is based on the object of proposing an expansion valve and a method for controlling the expansion valve which is inexpensive to produce and assemble, and of allowing simple actuation for operation of the refrigerant cycle, with as far as possible an optimum high pressure being established upstream of the expansion valve.

According to the invention, this object is achieved by a method for controlling an expansion valve, in particular for vehicle air-conditioning systems operated with $CO_2$ as refrigerant, having a valve housing, in which an entry pressure is present in a feed opening on the high-pressure side and an exit pressure is present in a discharge opening on the low-pressure side, having a valve-closure member, which is moved in the opening direction out of a valve seat of a passage opening, which is arranged between the feed opening and the discharge opening, to allow the refrigerant to flow through, characterized in that a section of the opening or closing movement of the valve-closure member over a range which is at least partially to be regulated is controlled as a function of the level of a pressure difference between the entry pressure of the feed opening and the exit pressure of the discharge opening.

According to the invention, the pressure difference between the entry pressure present in the feed opening on the high-pressure side and the exit pressure present in the discharge opening on the low-pressure side of the refrigerant cycle is used to control the opening or closing movement of the valve member. The pressure conditions which are actually present in the refrigerant cycle are in this case used to open and close the valve member, thereby controlling a mass flow passing through the expansion valve.

For lower ambient temperatures, for example in autumn and winter, the high pressure at the entry of the expansion valve is between 50 and 70 bar, whereas during the summer the high ambient temperatures require a high pressure of between 100 and 120 bar. The low pressure remains between 35 and 45 bar in winter and in summer. The accurate control of the valve-closure member by means of the differential pressure results in the mass flow of refrigerant being metered in a manner which is optimum in terms of energy irrespective of the absolute pressures at the entry of the expansion valve.

According to an advantageous configuration of the invention, it is provided that an opening cross section between the valve-closure member and the valve seat changes continuously as a function of the pressure difference. The change in the pressure difference has a direct effect on the change in the opening cross section of the valve, so as to provide direct control of the mass flow. This allows the pressure drop across the expansion valve as a whole or the optimum high pressure that is to be set to be effected in the desired way on the basis of the actual conditions.

According to a further advantageous configuration of the method, it is provided that the opening instant for the through-bore is set by a restoring device which acts counter to the opening direction of the valve-closure member. This can allow fine tuning in order to additionally set the pressure-difference range beyond which the valve-closure member is opened.

According to the invention, the object on which the invention is based is achieved by an expansion valve in which a mass flow through the valve which is required for operation of the refrigerant cycle with an optimum high pressure is determined from the entry pressure in the feed opening, the exit pressure in the discharge opening and from the temperature upstream of the valve-closure member, from which information it is possible to derive the required valve opening cross section. The use of these parameters to determine the valve opening cross section allows the desired mass flow to flow through the expansion valve as a function of the pressure difference, since the pressure difference in turn determines the opening or closing movement of the valve-closure member. This allows the optimum high pressure to be reached and maintained in the super-critical range, i.e. for ambient temperatures of greater than approximately 27° C. In the sub-critical range, the lower condensation pressure means that a smaller valve opening cross section is set in the external heat exchanger, which approximates to optimum operation in terms of energy. This leads to an increase in the coefficient of performance COP, which is defined by the ratio between the refrigeration capacity, i.e. the quantity of heat on the evaporator side, and the working power for the compressor. This coefficient of performance has an optimum in both the sub-critical range and the super-critical range, this optimum being dependent mainly on the refrigerant temperature downstream of the external heat exchanger or also on the ambient temperature, i.e. the air temperature at the inlet of the external heat exchanger. The mode of operation which is optimum in terms of energy is then achieved if the maximum refrigeration power is produced for the lowest possible driving power. To achieve an optimum COP in the sub-critical range, the expansion valve should be closed to such an extent that a low level of supercooling occurs at the external heat exchanger. If the valve opening is set to be larger, the COP deteriorates to an increasing extent, since the mass flow of refrigerant and therefore the driving power of the compressor rise or the enthalpy of vaporization which is available drops. If the expansion valve closes too much, i.e. if the opening cross section is reduced excessively, the high pressure rises on account of the lower mass flow, and so does the compressor drive power. In this case, however, a more rapid deterioration in the COP is observed, as illustrated, for example, in FIG. 4*b*.

The trans-critical range is distinguished by precisely the opposite characteristics. Starting from an optimum COP which is reached for a defined high pressure, a reduction in the valve cross section leads to a direct increase in the high pressure and to a drop in the COP. In the other direction, an increase in the size of the valve cross section leads to a drop in the high pressure and the COP. However, the deterioration in the COP is significantly more pronounced in the latter direction.

Furthermore, the object on which the invention is based is achieved, according to the invention, by an expansion valve in which an opening force, which results from a pressure difference between an entry pressure of the feed opening and an exit pressure of the discharge opening, moves a valve-closure member in the opening direction, counter to the restoring device. This expansion valve is controlled by the opening force resulting from the pressure difference, thereby allowing the mass flow passing through the expansion valve to be matched to the actual ambient conditions without the need for any electrical assistance.

According to an advantageous configuration of the invention, it is provided that the opening direction of the valve-closure member is provided to be in the direction of flow of the refrigerant. This makes it possible to create favourable flow properties, thereby reducing losses of mass flow during flow through the throttling location or the passage opening.

According to a preferred configuration of the invention, the valve-closure member has a closure body which is provided on the exit pressure side with respect to the valve seat and extends through a passage opening on the entry pressure side. This results in a simpler structure of the valve-closure member, allowing the opening cross section to be changed continuously by means of the relative movement with respect to the valve seat.

It is advantageously provided that the valve-closure member has a closure body which comprises a conical closure surface. This allows the opening cross section to be continuously increased in size during an opening movement of the valve-closure member. Furthermore, as an alternative it is possible to provide for the conical closure surface to be designed with a convexly or concavely curved lateral surface. This allows mass flows for pressure expansion to be controlled as a function of the working points on the high pressure side, so that a nonlinear change in the opening cross section for the mass flow is provided as a function of the actuating travel. The external geometries of the closure body and of the valve seat are matched to the desired volumes of the mass flow at the respective working pressures, which are to be set as a function of the opening movement in order to obtain optimum high-pressure operation.

According to a further advantageous configuration of the invention, it is provided that the closure body of the valve-closure member is surrounded by a nozzle opening of a nozzle apparatus, which has a greater opening width than the peripheral surface of the closure body on the exit pressure side. This results in free outgoing flow and flow through the passage opening. At the same time, the valve-closure member can be held trapped in the nozzle apparatus by means of the valve seat. Alternatively, it is also possible for the valve-closure member to be arranged exclusively on the entry pressure side or the exit pressure side, in which case the restoring device is arranged in a corresponding way in order to keep the passage opening closed during pressure compensation or in the event of a predeterminable low pressure difference.

According to an advantageous embodiment of the invention, the valve member is guided by a guide portion in a nozzle apparatus and positioned opposite it in a valve seat. This configuration of the nozzle apparatus allows the expansion valve to be constructed with a small number of components. This nozzle apparatus can advantageously be fitted in the housing by pressing, clamping, screwing or the like.

The mass flow is advantageously fed to the nozzle apparatus via transverse bores between the guide portion and the valve seat. These transverse bores preferably open out directly to the through-opening at the valve seat, so that an unimpeded feed and passage of the refrigerant through the through-opening is possible in the open position.

Outside a guided portion through the nozzle apparatus, the valve-closure member has a holding portion, at which a setting apparatus which fixes the restoring device with respect to the nozzle apparatus is provided. This makes it possible for the nozzle apparatus together with the valve-closure member to be designed as a single part that can be inserted into a housing. At the same time, the setting apparatus allows fine setting of the opening instant by setting the prestressing force of a restoring device, which is advantageously designed as a spring.

The setting apparatus is advantageously arranged displaceably on the holding portion. This can be effected by means of a screw thread or by means of sliding guidance and a clamping connection or the like.

Furthermore, it is advantageously possible to provide for the valve-closure member to have a sleeve with damping tabs which engage on an inner wall of the feed or discharge opening. These damping tabs prevent the valve-closure member from vibrating and delay the actuating movement resulting from the differential pressure at least slightly, so that a calmer mass flow is achieved.

According to a preferred embodiment, the restoring device is designed as a spring element, in particular as a spring element which can be placed under compressive stress. This spring element is advantageously arranged coaxially with respect to the valve-closure member. Alternatively, it is also possible to provide, as an advantageous embodiment, for the restoring device to be arranged adjacent to the valve-closure member or to be positioned opposite the valve-closure member, in order to obtain the self-retaining closed position.

According to a further preferred embodiment of the invention, it is provided that the closure force of the restoring device or the opening characteristic curve of the valve-closure member is determined according to the minimum required mass flow of the refrigerant as a function of the pressure difference which is present. This allows accurate setting of the opening instant for the desired volume of the mass flow to pass through.

It is preferable for the closing force of the restoring device or the opening characteristic curve of the valve-closure member to be determined according to a linear or curved function of the flow of refrigerant by means of the pressure difference which is present. This allows an accurate setting of the expansion valve. At the same time, this makes it possible to determine the opening cross section of the through-opening as a function of the pressure difference, which in turn influences the geometry of the closure body and/or valve seat.

According to a further advantageous configuration of the invention, it is provided that a compact design is made possible by the particular configuration of the nozzle apparatus and the valve-closure member which it accommodates. This leads to simple geometric configurations of the housing and enables the feed and discharge line to and from the expansion valve to be connected directly to the housing. This allows the number of connection points to be reduced and the connection points to be simplified.

According to the invention, the expansion valve may also be designed as an assembly comprising a nozzle, a closure body and a restoring device. This assembly may, for example, be integrated in a connection piece fitted to the evaporator or elsewhere. This allows still further connection points to be eliminated. By way of example, the nozzle may have releasable securing elements, such as for example a screw connection, at the outer periphery, thereby allowing simple assembly and exchange of the valve in a simple way.

BRIEF DESCRIPTION OF THE DRAWINGS

The invention and further advantageous embodiments and refinements of the invention are described and explained in more detail below on the basis of the example shown in the drawing. The features to be found in the description and the drawing can be used individually on their own or in any desired combination in accordance with the invention. In the drawing:

FIG. 2 illustrates two refrigerant cycle processes in accordance with FIG. 1 in the form of a Mollier diagram.

DETAILED DESCRIPTION OF THE INVENTION

Figure 1:
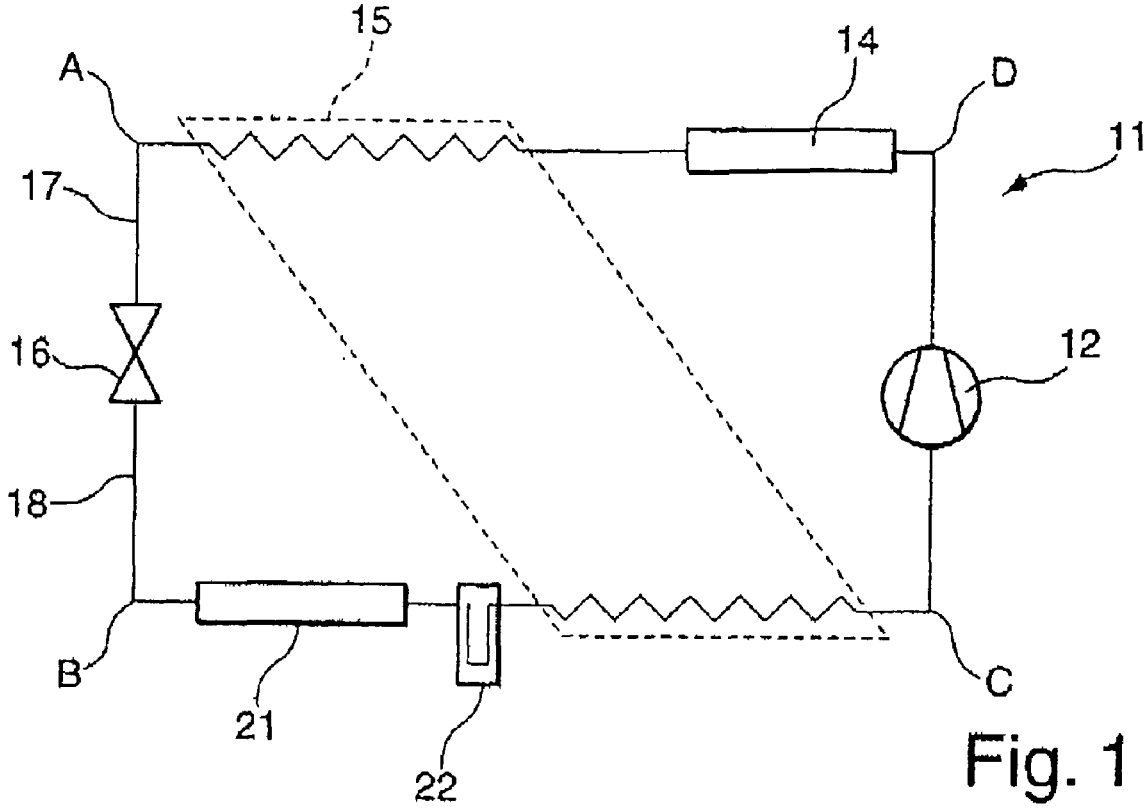
FIG. 1 diagrammatically depicts a refrigerant cycle process.

FIG. 1 illustrates a refrigerant cycle 11 which is preferably operated with $CO_2$ as refrigerant. A compressor 12 feeds the compressed refrigerant to an external heat exchanger 14 on the high pressure side. The external heat exchanger 14 is connected to atmosphere and dissipates heat to the outside. An internal heat exchanger 15, which feeds the refrigerant to an expansion valve 16 via a feed line 17, is connected downstream of the external heat exchanger. Upstream of the expansion valve 16 on the high-pressure side is an entry pressure which may, for example, be 120 bar in the summer and up to 80 bar in the winter. The refrigerant flows through the expansion valve 16 and reaches the low-pressure side. On the exit side, the expansion valve 16 provides pressures of between 35 and 45 bar. The refrigerant which has been cooled through the pressure expansion passes via a discharge line 18 into the internal heat exchanger 21 and withdraws heat from the surroundings, with the result that, for example, a vehicle passenger compartment is cooled. A collection manifold 22 is connected downstream of the heat exchanger 21. The refrigerant in vapour form flows through the internal heat exchanger 15 and reaches the compressor 12.

This refrigerant cycle as shown in FIG. 1 is illustrated in the form of Mollier diagram in accordance with FIG. 2. In this diagram, the enthalpy h is plotted along the x axis and the pressure of the refrigerant is plotted on the y axis. The curve 24 shows the boundary region between the gaseous and liquid phases of the refrigerant. For orientation, the characteristic curve 26 is illustrated by way of example as an isotherm corresponding to 31° C. The point of contact between characteristic curves 24 and 26 is the critical point 27, which for example for the refrigerant $CO_2$ corresponds to a temperature of 31° C. and a pressure of 73.8 bar. The continuous line 29 shows the state of the $CO_2$ refrigerant when the air-conditioning system is operating in the trans-critical process. The respective points A to D correspond to the states at points A to D in FIG. 1. The characteristic curve 31 shown in dashed lines shows the states of a refrigerant cycle in accordance with FIG. 1 during a sub-critical cycle process.

Figure 3:
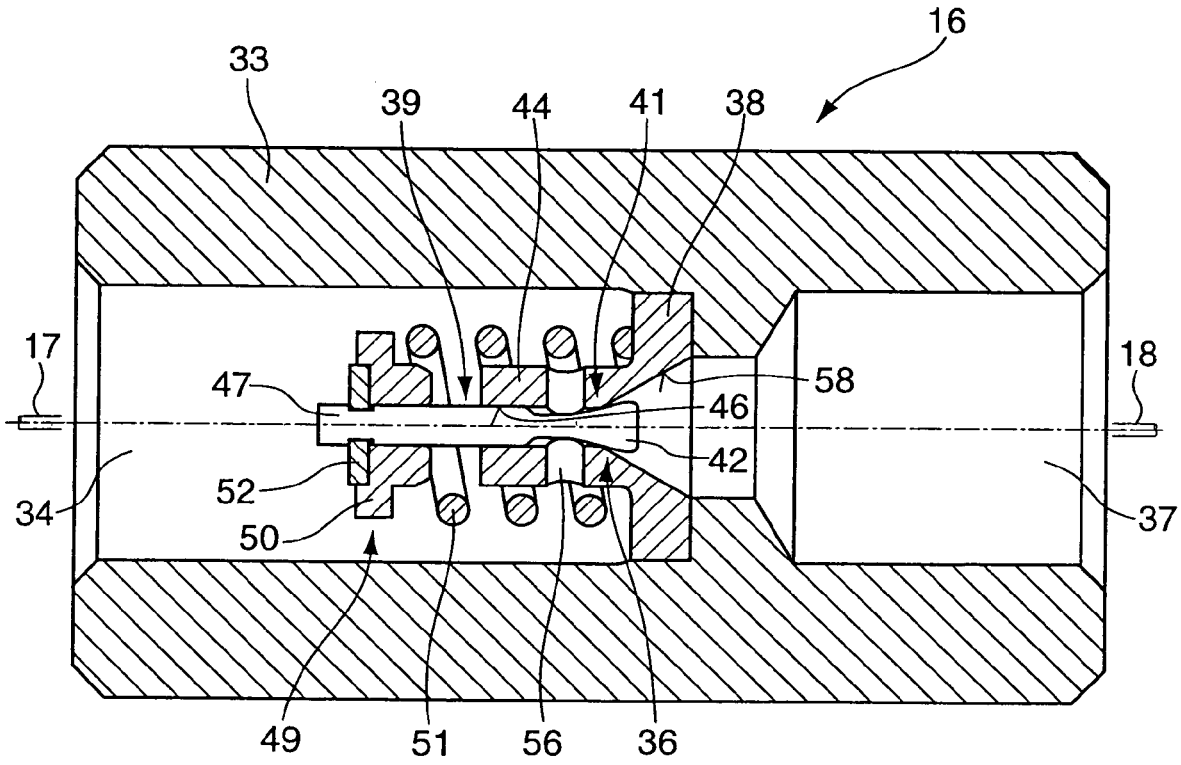
FIG. 3 shows a diagrammatic sectional illustration of an expansion valve according to the invention.

FIG. 3 shows a diagrammatic sectional illustration through an expansion valve 16 according to the invention. In a valve housing 33 there is a feed opening 34 which is connected via a passage opening 36 to a discharge opening 37. A nozzle apparatus 38 is provided in the feed opening 34. This nozzle apparatus may be secured by being pressed, adhesively bonded or screwed into place or by a further auxiliary means, such as a screwed connection or clamping connection. The nozzle apparatus 38 accommodates a valve-closure member 39 in the passage opening 36. A closure body 42 of the valve-closure member 39 is arranged on the exit pressure side with respect to the passage opening 36. On the entry pressure side or high-pressure side, the valve-closure member 39 has a portion 46 which is guided by a guide portion 44 and is adjoined by a holding portion 47. A restoring device 51 is arranged between the setting apparatus 49 and the nozzle apparatus 38. The setting apparatus 49 comprises a disc-like element 50 having a shoulder, on which the restoring device 51, which is preferably designed as a compression spring, is supported. The disc-like element 50 is fixed with respect to the holding portion 47 by means of a securing disc 52. The disc-like element 50 can be displaced along the holding portion 47 as a function of the prestressing force which is to be set.

The nozzle apparatus 38 has transverse bores 56, which are in communication with the passage opening 36, between a valve seat 41 and the guide portion 44. In the transition region between the passage bores 56 and the valve seat 41, the valve-closure member 39 is of narrowed design compared to the guided portion 46, so that the refrigerant reaches the passage opening 36.

The valve-closure member 39 has a conical closure body 42 which forms a ring-like closure with a valve seat 41. The nozzle apparatus 38 has a nozzle opening 58 which is widened with respect to the conical closure body 42.

The embodiment of the valve-closure member 39 illustrated in FIG. 3 allows self-centring positioning of the closure body 42 with respect to the valve seat 41. Furthermore, a simple and compact configuration is also permitted.

The procedure described below is adopted with regard to the designing of an opening cross section between the closure body 42 and the valve seat 41 as a function of the displacement travel of a valve-closure member 39, so that control of the valve-closure member 39 on the basis of the pressure difference between the high-pressure side and the low-pressure side is made possible.

First of all, the optimum refrigeration capacity which can be achieved is defined for the prevailing ambient temperature. The prevailing ambient temperature and the desired refrigeration capacity can be determined, for example, by simulation on the basis of a refrigerant cycle process as shown in FIG. 2. The optimum high pressure which is to be set results from the ambient temperature, since the cycle process control functions on the basis of the principle of high-pressure control. The available enthalpy difference $\Delta h$ between points B and C, i.e. the entry to the internal heat exchanger 21 and its exit, can be determined from a resulting cycle diagram as shown in FIG. 2 and/or from the simulation. The mass flow required is determined directly from the formula $m=Q_0/\Delta h$ (mass flow=refrigeration capacity/enthalpy difference). The opening cross section which is required for the desired mass flow m can be determined from the thermodynamic variables, such as according to point A, pressure upstream of the expansion valve 16 and point B, pressure downstream of the expansion valve 16, and also the temperature upstream of the expansion valve 16. Therefore, this opening cross section can be transferred to the size of the passage opening and/or the valve seat 41 and the closure body 42. In particular the geometry of the closure body 42 is configured as a function of these values. At the same time, the opening force for the valve-closure member 39 is determined, so that the restoring device 51 closes the valve at least during pressure compensation.

To optimize the high-pressure control, which is dependent on the temperature, the valve opening cross section is maximized with respect to the coefficient of performance. With regard to the design, reference is made to FIGS. 4*a*, 4*b* and 5.

Figure 5:
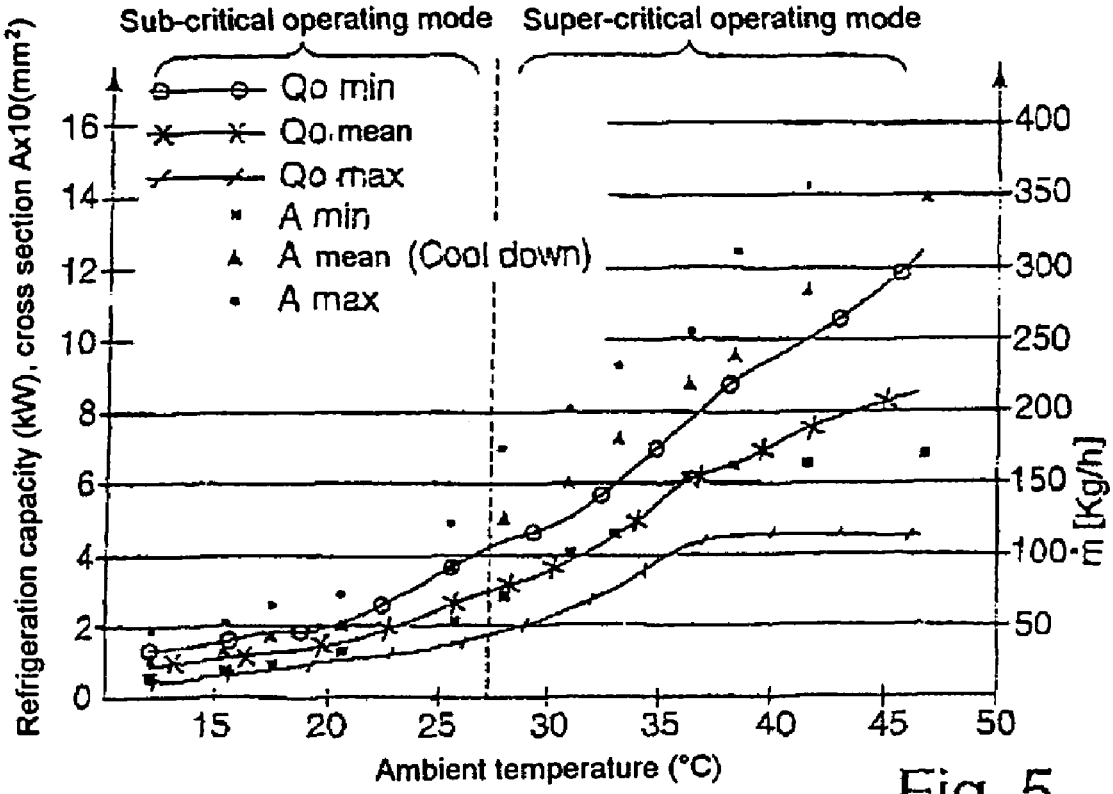
FIG. 5 shows a diagram illustrating the refrigeration capacity, the mass flow of refrigerant and the valve opening cross section plotted against the ambient temperature.

FIG. 5 illustrates a diagram in which the refrigeration capacity $Q_0$, the valve opening cross section and the mass flow of refrigerant are plotted against the ambient temperature for a given system. Furthermore, the minimum, the maximum and the arithmetic mean of the three parameter variables are recorded for the respective ambient temperatures. The maximum values are reached, for example, during cooling of the vehicle, and the minimum values are reached, for example, during steady-state operation. Above an ambient temperature of between 25 and 30° C., the optimum high pressure of a $CO_2$ cycle exceeds the critical value of 73.8 bar.

Figure 4A:
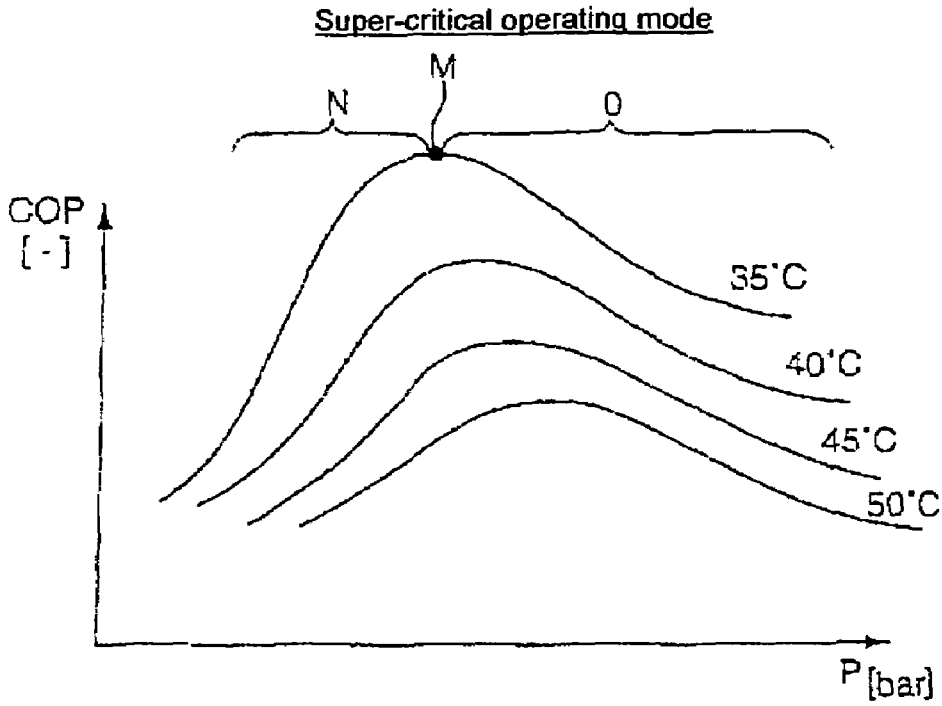
FIG. 4*a* shows a diagram illustrating the ratio of the coefficient of performance to the high pressure for the supercritical operating mode as a function of the refrigerant temperature downstream of an external heat exchanger.

FIG. 4*a* illustrates a diagram in which a characteristic curve is plotted as a function of the refrigerant temperature downstream of the external heat exchanger 14 as a function of the high pressure and the coefficient of performance. The optimum opening cross section for the respective refrigerant temperature is given at a maximum M of the line. If the cross section is not set optimally, i.e. is too large or too small, the coefficient of performance deteriorates. To achieve an optimum mode of operation, the cross section is at least to some extent configured for the maximum M or in a range O. The range O shows that although the optimum COP drops, this is associated with an increase in the high pressure. This range is more favourable in design terms than the range N. This range shows the conditions when the valve opening cross section is being increased. This increase leads to a drop in the high pressure and the COP, and consequently in this direction the deterioration in the COP is significantly more pronounced and therefore has more of a detrimental effect. The slower drop in the COP in range O gives better results for the configuration of the overall range.

Figure 4B:
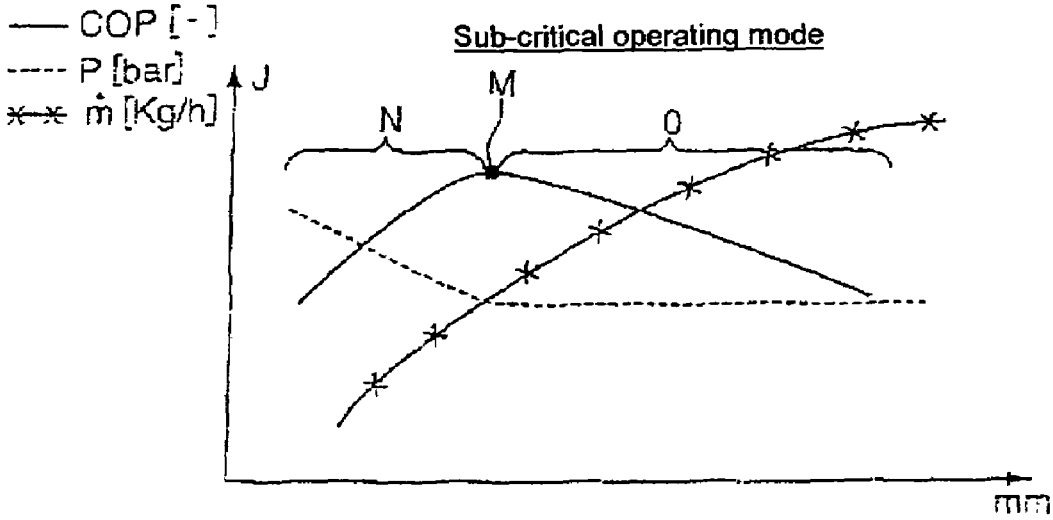
FIG. 4*b* shows a diagram which illustrates the ratio of a valve opening cross section to the coefficient of performance, to the high pressure and to the mass flow of refrigerant for the sub-critical mode of operation.

FIG. 4*b* plots the parameters mass flow, coefficient of performance COP and high pressure against the valve cross-section for the sub-critical operating situations. In this case, unlike in diagram 4*a*, it is not feasible to illustrate the parameters on the basis of the high pressure, since the optimum coefficient of performance cannot be unambiguously assigned to the high pressure. The diagram shows that, starting from the right-hand side of the curves, closure of the valve continuously reduces the mass flow for a given refrigeration capacity. Over the range O, the high pressure remains constant but the coefficient of performance COP increases continuously. This is explained by the fact that the compressor work behaves in the same way as the circulated refrigerant stream for as long as the pressure difference between the high pressure and the low pressure which is to be overcome remains unchanged.

At point M in FIG. 4*b*, the COP reaches its maximum, and the high pressure begins to rise at this valve cross section. This operating point is therefore the optimum point for the air-conditioning system. In the range N to the left of the optimum point, the valve cross section decreases further and the high pressure rises further. The COP drops considerably, since the compressor, on account of the pressure difference which is present, is continuously increasing.

Rules for the design of the valve cross section as a function of the pressure difference which is present and/or for the expected refrigeration capacities at different ambient temperatures can be derived from FIGS. 4*a* and 4*b*.

The pressure differences to be set between the valve inlet side and the valve outlet side are lower in the sub-critical operating mode than in the super-critical operating mode. To achieve as high a coefficient of performance as possible for the sub-critical operating states, the valve cross section is set in such a manner that point M in FIG. 4*b* is reached for an expected refrigeration capacity which is close to the maximum capacity. The result of this is that when the refrigeration capacities are lower the valve cross section selected is slightly too large. In this case, the drop in COP is lower (range O) than for the range N.

In the super-critical operating situation, a reduction in valve cross section means that the high pressure rises further. As can be seen from FIG. 4*a*, the COP characteristic curve tends to have a lower rate of decrease in this direction than in the range N. The valve design for the super-critical operating situations is implemented for or close to the lower expected refrigeration capacities, at which an optimum high pressure assigned to point M is set for the respective temperature. As the demand for refrigeration capacity rises, the high pressure will rise further (range O) and a slight decrease in COP will occur.

Therefore, as has been explained above, the geometry of the closure body and of the valve seat are configured for the sub-critical and trans-critical range. In addition, the opening and/or closing force of the restoring device is also taken into account.

The determination of the opening cross section leads to the opening instant of the valve-closure member 39 and the actuation travel or opening travel of the valve-closure member 39 and therefore the opening cross section being determined as a function of the pressure difference. Therefore, an arrangement and configuration of an expansion valve 16 which is of compact design and operates at the optimum high pressure at least in part and preferably over the entire range of use, can be created without the need for any additional electronic control.

Figure 6:
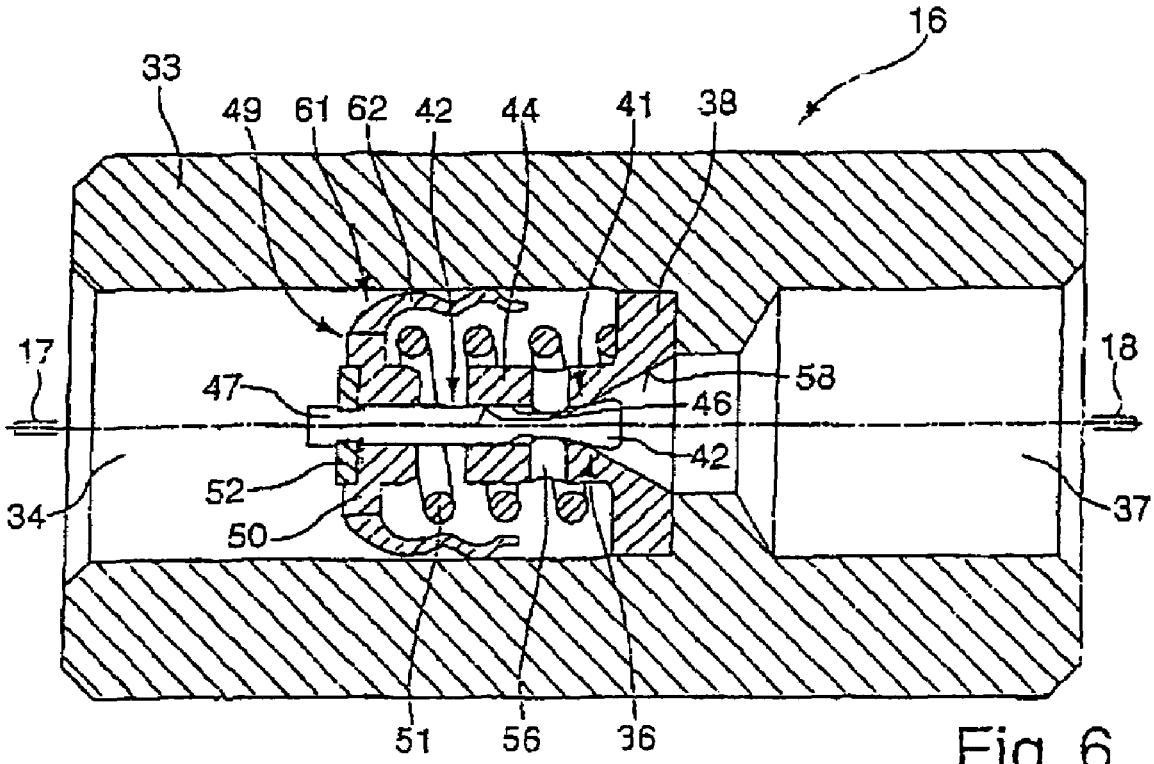
FIG. 6 shows a diagrammatic sectional illustration through an alternative embodiment of the expansion valve.

FIG. 6 illustrates an alternative configuration of an expansion valve 16 to that shown in FIG. 3. In the case of this expansion valve 16, the setting apparatus 49 comprises a sleeve 61 through which refrigerant can flow and at which damping tabs 62 are formed. These damping tabs 62 slide along the inner wall of the feed opening 34 and effect a damped or at least slightly decelerated opening and closing movement of the valve-closure member 39. The sleeve 61 and the damping tabs 62 arranged on it may also be arranged on the exit pressure side and connected to the closure body 42.

Figure 7:
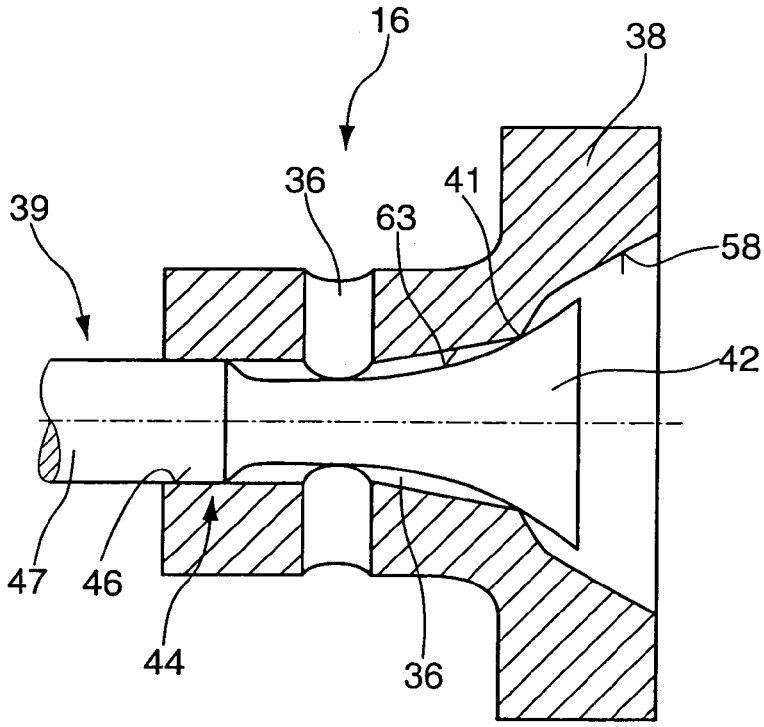
FIG. 7 shows a diagrammatically enlarged partial view of an alternative embodiment of a valve-closure member, and FIGS. 8*a* & b show diagrammatic enlarged sectional illustrations through a further alternative embodiment of a valve-closure member.

FIG. 7 shows an enlarged detail illustration of an alternative embodiment of a valve-closure member 39. The closure body 42 has a lateral surface, which is curved inwards towards the longitudinal centre axis of the valve-closure member 39, as its closure surface. This makes it possible to achieve opening cross sections which are suitably matched to the ambient temperatures as a function of the geometry of the valve seat 41 and of the closure surface 63 which adjoins it on the entry pressure side. The geometries of the closure body 42 and of the valve seat 41 may also be designed in stepped form, with different inclinations, as conical surfaces and outwardly curved surfaces or the like.

Figure 8A:
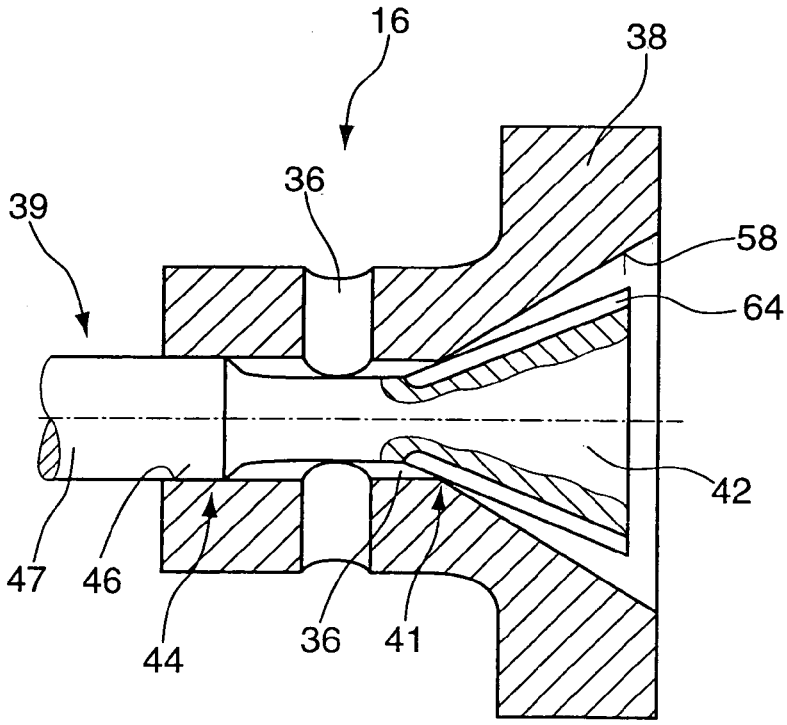
Figure 8B:
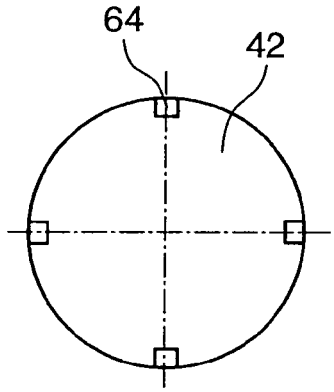

FIGS. 8*a* and *b* illustrate an enlarged sectional illustration through a further alternative embodiment of a valve-closure member 39. At the closure body 42 there is at least one recess 64, with the result that a small mass flow of refrigerant always flows through the passage opening 36. Therefore, the valve-closure member 39 only opens after a predetermined differential pressure has been exceeded. The recesses 64 may, for example, be designed as rectangular grooves or as semicircular recesses or as cutouts at the valve seat 41 and/or closure body 42. Alternatively, it is also possible to provide for the closure body 42 not to come into contact with the valve seat 41, by virtue of the return stroke travel or the closure travel being limited by a stop and therefore a slightly open cross section being provided.

The features and embodiments which have been described in connection with the exemplary embodiments are each individually pertinent to the invention and can be combined with one another in any desired way.

We claim:

1. Method for controlling air-conditioning systems having an expansion valve which is positioned between an external heat exchanger on the high pressure side and an internal heat exchanger on the low pressure side having a valve housing, in which an entry pressure is present in a feed opening on the high-pressure side and an exit pressure is present in a discharge opening on the low-pressure side, having a valve-closure member, which is moved in the opening direction out of a valve seat of a passage opening, which is arranged between the feed opening and the discharge opening, to allow the refrigerant to flow through and having an opening or closing movement of the valve-closure member over a range which is at least partially to be regulated is controlled as a function of the level of a pressure difference between the entry pressure of the feed opening and the exit pressure of the discharge opening, wherein said method comprises the steps of:

determining a coefficient of performance for the range to be regulated for the opening and closing movement of the valve-closure member, which is defined by the ratio between the refrigerant capacity of the internal heat exchanger and a working power of the compressor, determining the optimum of the coefficients of performance in the supercritical range and the sub-critical range by the maximum refrigeration capacity for the lowest possible working power of the compressor, and deriving from the optimum of the coefficients of performance the opening characteristic curve of the valve-closure member, which is determined based on the respective pressure difference between the high and low pressure side, on the temperature upstream of the valve-closure member and on the mass flow.

2. Method according to claim 1, characterized in that an opening cross section between the valve-closure member and the valve seat changes continuously as a function of the pressure difference.

3. Method according to claim 1, characterized in that the valve-closure member is held in the valve seat in the event of pressure compensation.

4. Method according to claim 1, characterized in that an opening instant for the passage opening is set by a restoring device which acts counter to the opening direction of the valve-closure member.

5. Method according to claim 1, characterized in that a setting apparatus which acts on the valve-closure member and which receives the restoring device is displaced along a holding portion of the valve-closure member in order to set the opening instant.

6. Expansion valve, in particular for vehicle air-conditioning systems operated with CO2 as refrigerant, having a valve housing, which includes a feed opening and a discharge opening, having a valve-closure member, which closes a valve seat of a passage opening arranged between the feed and discharge openings, and having a restoring device, which acts in the closing direction of the valve-closure member and is movable in the opening direction, counter to the force of the restoring device, by an opening force which results from a pressure difference between an entry pressure of the feed opening and an exit pressure of the discharge opening wherein the valve-closure member is provided with an opening characteristic curve which is determined on the basis of the minimum mass flow of refrigerant required for the trans- critical range and the maximum mass flow of refrigerant required for the sub-critical range.

7. Expansion valve according to claim 6, characterized in that the opening direction of the valve-closure member is provided in the direction of flow of the refrigerant.

8. Expansion valve according to claim 6, characterized in that the valve- closure member has a closure body which is provided on the exit pressure side with respect to the valve seat and extends through the passage opening on the entry pressure side.

9. Expansion valve according to claim 6, characterized in that the valve- closure member has a closure body with a conical closure surface, a convexly or concavely curved lateral surface as closure surface, or a conical closure surface which is in stepped form with at least two different inclinations.

10. Expansion valve according to claim 6, characterized in that the valve-closure member has a closure body surrounded by the nozzle opening of a nozzle apparatus, which has a greater opening width than the peripheral surface of the closure body.

11. Expansion valve according to claim 6, characterized in that the valve- closure member is guided by a guide portion in a nozzle apparatus with the valve seat arranged opposite it.

12. Expansion valve according to claim 11, characterized in that at least one transverse bore, which connects the feed opening to the passage opening, is provided between the guide portion and the valve seat in the nozzle apparatus.

13. Expansion valve according to claim 6, characterized in that a setting apparatus, which acts on the valve-closure member and fixes the restoring device with respect to the nozzle apparatus, is provided outside a guided portion of the valve-closure member.

14. Expansion valve according to claim 6, characterized in that the a setting apparatus is arranged such that it is displaceable along a holding portion of the valve- closure member.

15. Expansion valve according to claim 6, characterized in that the valve-closure member has a sleeve with damping tabs which engage on an inner wall of the feed opening or discharge opening and that the sleeve is provided at the setting apparatus.

16. Expansion valve according to claim 6, characterized in that the restoring device is designed as a spring element which is arranged coaxially with or adjacent to the valve-closure member.

17. Expansion valve according to claim 6, characterized in that at least a closure body of the valve-closure member or the valve seat has an elevation or recess, leading to a flow area of the passage opening as a basic opening in a closed position of the valve-closure member arranged towards the valve seat which is opened up.

18. Expansion valve according to claim 6, characterized in that the closing force of the restoring device is determined on the basis of the minimum mass flow of refrigerant required for the trans-critical range and the maximum mass flow of refrigerant required for the sub-critical range and at least the closing force of the restoring device or the opening characteristic curve of the valve-closure member is determined on the basis of a linear or curved function of the flow of refrigerant.

19. Expansion valve according to claim 6, characterized in that the feed and discharge openings of the valve housing are directly connected to a feed line and discharge line.

20. Expansion valve according to claim 6, characterized in that a mass flow of the refrigerant through the passage opening, which is required for operation of the refrigeration cycle with an optimum high pressure, is determined from the entry pressure in the feed opening, the exit pressure in the discharge opening and from the temperature upstream of the valve-closure member, and the required opening cross section is derived from this information.

* * * * *